US006817233B2

(12) United States Patent
Toiyama et al.

(10) Patent No.: US 6,817,233 B2
(45) Date of Patent: Nov. 16, 2004

(54) INJECTION-AMOUNT MEASURING UNIT

(75) Inventors: Seigi Toiyama, Okazaki (JP); Koji Mizukusa, Chita-gun (JP)

(73) Assignee: Denso Corporation, Aichi-Pref. (JP)

( * ) Notice: Subject to any disclaimer, the term of this patent is extended or adjusted under 35 U.S.C. 154(b) by 9 days.

(21) Appl. No.: 10/133,430

(22) Filed: Apr. 29, 2002

(65) Prior Publication Data

US 2002/0174717 A1 Nov. 28, 2002

(30) Foreign Application Priority Data

Apr. 27, 2001 (JP) ..... 2001-132571

(51) Int. Cl.[7] ..... G01M 15/00
(52) U.S. Cl. ..... 73/119 A
(58) Field of Search ..... 73/116, 117.2, 73/117.3, 118.1, 119 A, 119 R

(56) References Cited

U.S. PATENT DOCUMENTS 5,988,142 A * 11/1999 Klopfer ..... 123/446
6,112,720 A * 9/2000 Matta ..... 123/446
6,354,276 B1 3/2002 Toiyama et al.
6,484,573 B2 * 11/2002 Bundock et al. ..... 73/119 A
6,532,809 B2 * 3/2003 Robinson ..... 73/119 A

* cited by examiner

*Primary Examiner*—Eric S. McCall
(74) *Attorney, Agent, or Firm*—Nixon & Vanderhye PC

(57) ABSTRACT

An injection-amount measuring unit, for measuring an injection amount of a fuel injector, employs a flow meter to measure a flow amount of a test fluid supplied from a pump and pumped through a fluid supply passage. A volume enlargement chamber of a volume member, is disposed around an upstream side of a fuel inlet of the fuel injector. A test fluid flows from a side of the pump into the volume enlargement chamber through the fluid inflow passage. The test fluid then flows from the volume enlargement chamber to a side of the fuel injector through the fluid outflow passage. When a needle opens an injection hole, transmitted waves and reflected waves, and resultantly, pressure pulsation, may be generated in the test fluid within the fuel injector. These waves and pulsation are eliminated.

12 Claims, 3 Drawing Sheets

INJECTION-AMOUNT MEASURING UNIT

CROSS REFERENCE TO RELATED APPLICATION

This application is based on, and claims the benefit of priority of, prior Japanese Patent Application No. 2001-132571 filed on Apr. 27, 2001, the contents of which are incorporated herein by reference.

BACKGROUND OF THE INVENTION

1. Field of the Invention

The present invention relates to an injection-amount measuring unit for measuring a fuel-injection amount of a fuel injector.

2. Description of Related Art

An injection-amount measuring device shown in FIG. 3 is a main part of an injection-amount measuring unit 110 for measuring an injection amount of an injector 100. A test fluid is supplied to the injector 100 from a pump (not shown) and the like through a fluid supply passage 115. A noncombustible fluid, substantially having the same viscosity as fuel, is used as the test fluid to prevent the test fluid from catching on fire, burning, and the like.

The injector 100 injects the test fluid from an injection hole 104 by detaching a needle 102 from a valve seat. That is, the needle 102 breaks contact with the valve seat 103. The needle 102 detaches from the valve seat 103 against an applied force of a spring 106 by energizing a coil 105. The spring 106 applies the force to the needle 102 in a direction where the needle 102 is seated on the valve seat 103 that is, in a direction causing the injection hole to close. The applied force of the spring 106 is adjusted using a feed distance of an adjusting pipe 107. The adjusting pipe 107 is guided by and enclosed within a housing 101.

The force of the spring 112 is applied to a valve member 111 of the injection-amount measuring device in a downward direction in FIG. 3. The valve member 111 is moved upward in FIG. 3 by attaching the injector 100 to the injection-amount measuring device 110 so that a fluid passage 116 provided in the valve member 111 communicates with the fluid supply passage 115. A flow meter 120 measures an amount of the test fluid flowing in the fluid supply passage 115 that is, an injection amount of the injector 100. A pressure gage 121 measures a pressure of the test fluid flowing in the fluid supply passage 115.

The needle 102 is made to reciprocate by supplying a pulse current shown in FIG. 4 to the coil 105. When the needle 102 is repeatedly seated on and detached from the valve seat 103 using an ON current and an OFF current of the pulse current, transmitted waves and reflected waves are generated 100 in the fluid within the injector. Then, as shown in FIG. 4, pressure pulsation is generated in the fluid within the injector. When the pressure pulsation is generated in the test fluid, the measured injection amount may fluctuate for every injection of the injector. The injection amount of injector can be accurately measured by increasing the number of injections and calculating an average injection amount. However, it takes a relatively long time to measure the injection amount in this manner.

A frequency of the pressure pulsation, a pressure wave shape and a pressure wave amplitude thereof are changed by a length, arrangement structure, and the like of piping for supplying the test fluid to the injector. Here, plural injection-amount measuring units are set, and a length, arrangement structure, and the like of piping for supplying the test fluid to the injector are changed for every injection-amount measuring unit. In this case, a frequency of the pressure pulsation, a pressure wave shape thereof and a pressure wave amplitude thereof are changed for every injection-amount measuring unit.

When the pressure pulsation of the test fluid injected by the injector is changed for every injection-amount measuring unit, the following trouble occurs. That is, even when a pulse current having the same pulse width and the same amplitude is applied to the coil of the same injector, and the test fluid having the same pressure is supplied, a measured result of the injection amount is changed for every injection-amount measuring unit. Further, when a measurement set value such as the pulse current and the test fluid pressure is changed, the measured injection amount using the changed measurement set value is sometimes changed for every injection-amount measuring unit.

SUMMARY OF THE INVENTION

Therefore, it is an object of the present invention to provide an injection-amount measuring unit for accurately measuring an injection amount of an injector in a relatively short period of time. It is another object of the present invention to provide an injection-amount measuring unit for measuring an injection amount which does not change for every injection-amount measuring unit.

In an injection-amount measuring unit according to an embodiment of the present invention, a passage area of a volume enlargement chamber is larger than a fluid inflow passage and a fluid outflow passage. Here, a fluid flows from a side of a fluid supply device into the volume enlargement chamber through the fluid inflow passage, and a fluid flows from the volume enlargement chamber to a side of a fuel injector (injector) through the fluid outflow passage. When a valve member of the injector performs intermittent fuel-injection, a pulsating pressure is generated in a fluid within the injector. When the pressure pulsation reaches the volume enlargement chamber from the fluid outflow passage, the pressure pulsation is reduced. That is, while a fluid is injected from the injector, fluctuating pressures of a fluid supplied to the injector can be reduced. Therefore, an injection amount can be accurately measured using a small number of injections, thereby performing a measuring operation in a small amount of time.

Here, multiple injection-amount measuring units are set, and a passage member changes in length and curvature for every injection-amount measuring device. Even in this case, when a pressure of a fluid supplied to the injector and a control current supplied to the electric driving member are set at the same values for every injection-amount measurement, injection-amount fluctuation of the injector is reduced for every injection-amount measuring unit. Accordingly, a degree of freedom of a set condition of the injection-amount measuring unit can be increased. In an injection-amount measuring unit according to an embodiment of the present invention, a feed distance of an adjusting pipe is adjusted so that a requested injection amount can be realized while the injection amount is measured. Accordingly, the injection amount of the injector can be adjusted in a small amount of time.

In an injection-amount measuring unit according to an embodiment of the present invention, the volume enlargement chamber is provided around a fuel inlet of the injector. Accordingly, the pressure pulsation generated in the fluid within the injector is immediately reduced. Here, multiple injection-amount measuring units are provided, and the passage member changes in length and curvature for every injection-amount measuring unit. Even in this case, when a pressure of a fluid supplied to the injector and a control current supplied to the electric driving member are set at the same values for every injection-amount measuring unit, injection-amount fluctuation of the injector can be further reduced for every injection-amount measuring unit.

In an injection-amount measuring unit according to an embodiment of the present invention, the fluid inflow passage and the fluid outflow passage are provided on lines different from each other, respectively. That is, the fluid inflow passage and the fluid outflow passage are not in the same line. Accordingly, the pressure pulsation can be effectively reduced in the volume enlargement chamber.

In an injection-amount measuring unit of an embodiment of the present invention, the fluid inflow passage and the fluid outflow passage are perpendicular to each other. Therefore, the pressure pulsation, transmitted from the injector into the volume enlargement chamber through the fluid outflow passage, experiences difficulty in transmitting the pulsation to the fluid inflow passage which is located to a side with respect to the fluid outflow passage. Accordingly, the pressure pulsation can be reduced in the volume enlargement chamber.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE PREFERRED EMBODIMENTS

The following description of the preferred embodiments is merely exemplary in nature and is in no way intended to limit the invention, its application, or uses.

Figure 1:
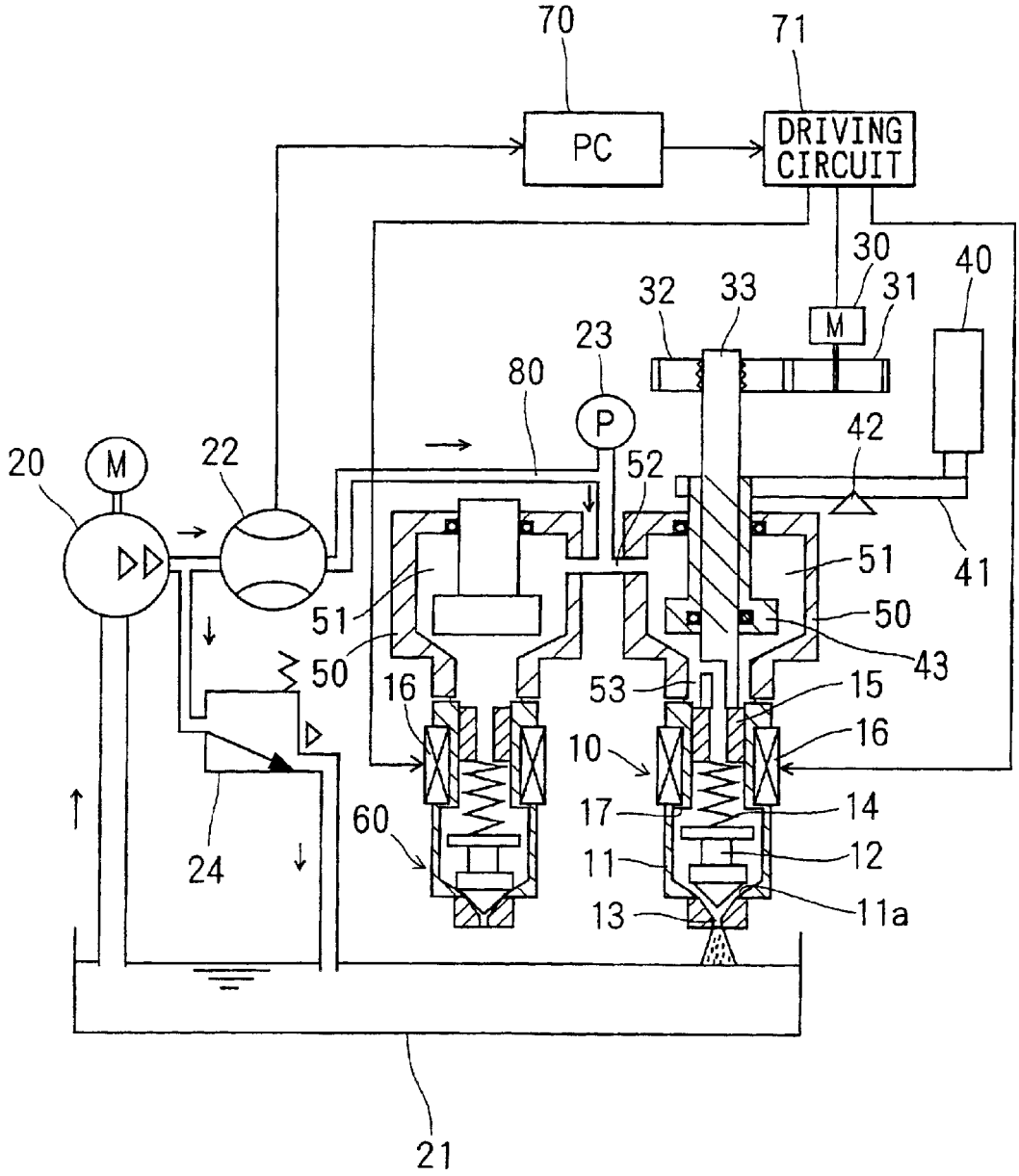
FIG. 1 is a cross-sectional view showing an injection-amount measuring unit according to an embodiment of the present invention.

As shown in FIG. 1, an injection-amount measuring unit according to an example of the present invention includes a pump 20 driven by an attached motor M, a flow meter 22, a pressure gage 23, a back pressure valve 24, a motor 30, a motor gear 31, a screw gear 32, a feed screw 33, a cylinder 40, an opening-closing rod 41, an opening-closing valve member 43 and a volume member 50.

An injector 10 is used for a gasoline engine, and it injects a test fluid from an injection hole 13 by detaching a needle 12 as a valve member from a valve seat 11*a*. A noncombustible fluid, having substantially the same viscosity as fuel, is used as the test fluid to prevent the test fluid from catching fire, igniting, and the like. A spring 14 applies a force to the needle 12 in a direction so that the needle 12 rests on the valve seat 11*a*, that is, in a direction that causes the injection hole 13 close. The applied force of the spring 14 is adjustable using a feed mechanism of an adjusting pipe 15 to change an adjusting distance. Here, the feed distance defines a distance traveled by the adjusting pipe 15 from an initial position to a desired feed position. The adjusting pipe 15 is fed into a housing 11 by press-fitting. When the adjusting pipe 15 reaches a predetermined feed distance, it is fixed to the housing 11 by crimping or the like. When a coil 16 energizes, it generates a magnetic force for moving the needle 12 away from the valve seat 11*a* (upward in FIG. 1) against the applied force of the spring 14. This, causes the needle 12 to be detached from the valve seat 11*a*.

When the feed distance of the adjusting pipe 15 is made larger, the applied force of the spring 14 increases. At this time, when a control pulse current having the same frequency, the same pulse width, and the same amplitude is supplied to the coil 16, an open time of the injector 10 per pulse becomes longer, and a closed time of the injector 10 per pulse becomes shorter. Therefore, an amount of the test fluid injected from the injector 10 per pulse is reduced. A flow amount, measured using a personal computer (PC) 70 based on a flow amount signal from a flow meter 22, is also reduced. Here, the open time defines a period of time between a beginning of an energizing of the coil 16 and a time when the needle 12 is stopped by a stopper 17. The closed time defines a period between a time when the energizing of the coil 16 is stopped and a time during which the needle is seated on the valve seat 11*a*.

The pump 20 draws a test fluid from a tank 21, and it supplies the test fluid to the injector 10 through a fluid supply passage 80. The flow meter 22 measures a flow amount of the test fluid flowing in the fluid supply passage 80, that is, an amount of the test fluid injected by the injector 10. For example, the flow meter 22 generates a pulse signal, and the number of pulses of the pulse signal for a unit time corresponds to the flow amount. The flow meter 22 outputs the number of pulses to the PC 70 as a flow amount signal. As the number of pulses from the flow meter 22 is increased, the flow amount, that is, the injection amount from the injector 10 is increased. The back pressure valve 24 adjusts a pressure of the test fluid supplied to the injector 10 at a predetermined pressure. A depression valve may be used in place of the back pressure valve 24.

The motor gear 31 rotated together with the motor 30 is engaged with the screw gear 32. The screw gear 32 is engaged with the feed screw 33 through a screw connection. The feed screw 33 travels upward or downward in FIG. 1 by rotation of the screw gear 32. The feed distance of the adjusting pipe 15 is increased by moving the feed screw 33 downward in FIG. 1.

A piston (not shown) is contained in the cylinder 40 and is capable of reciprocating in the cylinder 40. The opening-closing rod 41 moves circularly about a supporting point 42 by making the piston reciprocate. The opening-closing valve member 43 is connected to the opening-closing rod 41, and it opens and closes a fluid outflow passage 53 in a volume member 50. The opening-closing valve member 43 travels upward or downward in FIG. 1 independently from the feed screw 33.

The volume member 50 forms a part of a passage member through which the test fluid is supplied from the pump 20 to the injector 10. The volume member 50 is disposed around an upstream side of a fuel inlet of the injector 10, and it defines a volume enlargement chamber 51 therein. A passage area of the volume enlargement chamber 51 is larger than that of a fluid inflow passage 52 and that of the fluid outflow passage 53. Here, the test fluid flows from a side of the pump 20 into the volume enlargement chamber 51 through the fluid inflow passage 52. The test fluid flows from the volume enlargement chamber 51 to a side of the injector 10 through the fluid outflow passage 53. Further, the fluid inflow passage 52 and the fluid outflow passage 53 are not disposed on the same line, but they are substantially perpendicular to each other. That is, their fluid flow directions are substantially perpendicular to each other.

A dummy injector 60 has the same shape as injector 10 whose injection amount is measured. Energizing the coil 16 of the dummy injector 60 is stopped during a period between a time when the measuring for the injector 10 is started and a time when the measuring is stopped. Then, the test fluid is injected from the dummy injector 60 by energizing the coil 16 thereof during a period between a time when the measuring for the injector 10 is ended and a time when the measuring for the next injection of injector 10, is started. The test fluid flows in the fluid supply passage 80 while the injector 10 is not measuring, thereby preventing the flow amount measured by the flow meter 22 from substantially being reduced to zero. When the flow amount is substantially reduced to zero in the fluid supply passage 80, it takes time for the flow amount to increase to a level where the injection amount of the injector 10 can be accurately measured. Therefore, while the subsequent injection amount of injector 10 is exchanged with the measured amount of injector 10, the test fluid continuously flows in the fluid supply passage 80 by injecting the test fluid from the dummy injector 60. Thus, the flow-amount measurement can be performed immediately after the injection amount of injector 10 is exchanged with the measured amount of injector 10.

The PC 70 controls a control current supplied from a driving circuit 71 to the injector 10, the dummy injector 60 and the motor 30. The control current supplied to the motor 30 is controlled based on the flow-amount signal from the flow meter 22 so that the test fluid is injected from the injector 10 at a set amount (or flow rate, volume/time) and so that the feed distance of the adjusting pipe 15 is controlled. The feed distance is adjusted using the feed screw 33, and the applied force of the spring 14 is adjusted using the feed distance. The injection amount of the injector 10 is adjusted using the applied force. Then, the adjusting pipe 15 is fixed at a position where the flow amount measured by the flow meter 22 reaches a target amount.

Figure 2:
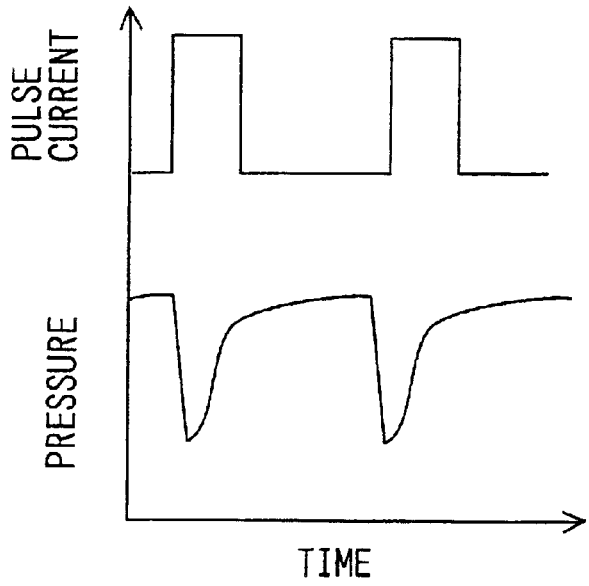
FIG. 2 is a characteristic graph showing a relationship between a pulse current supplied to a coil and a fluid pressure to be measured in an injector according to an embodiment of the present invention.
Figure 3:
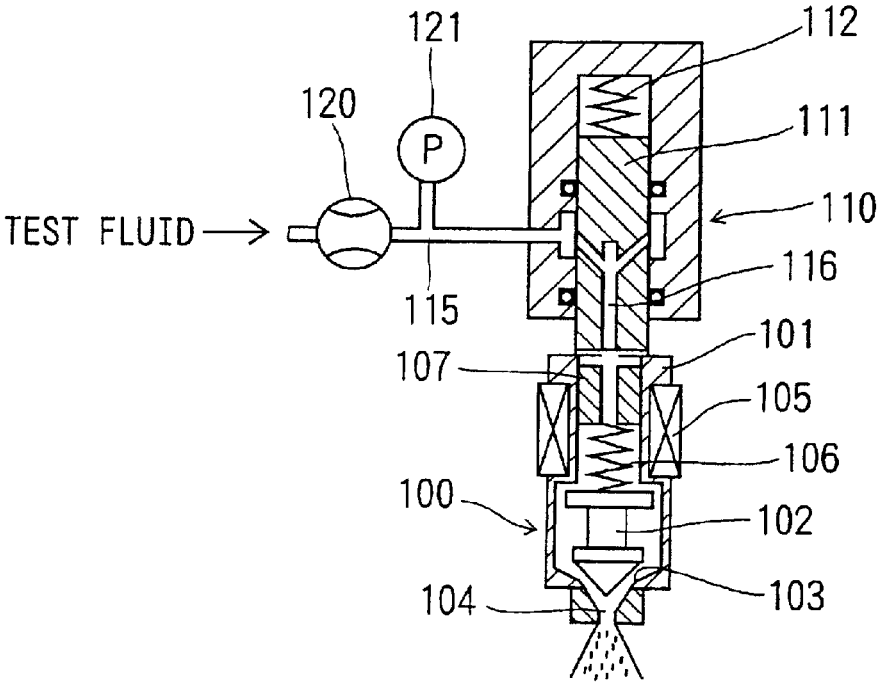
FIG. 3 RELATED ART
FIG. 3 is a cross-sectional view showing a main part of a conventional injection-amount measuring unit.
Figure 4:
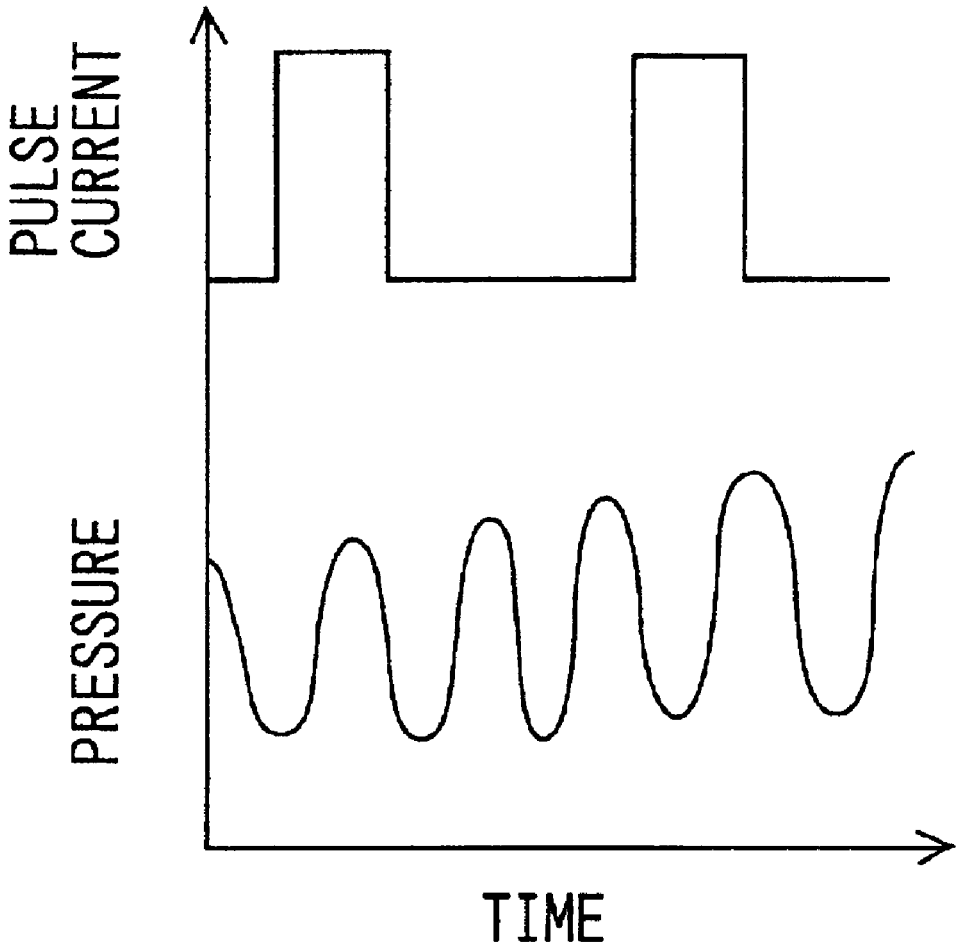
FIG. 4 RELATED ART
FIG. 4 is a characteristic graph showing a relationship between a pulse current supplied to a coil and a fluid pressure to be measured in an injector according to a conventional example.

In the present example, the volume member 50, defining the volume enlargement chamber 51, is disposed around the fuel inlet of the injector 10. A passage area of the volume enlargement chamber 51 is larger than that of the fluid outflow passage 53, and the volume enlargement chamber 51 has a large capacity. When the needle 12 opens the injection hole 13, transmitted waves and reflected waves may be generated in the test fluid within the injector 10, so that pressure pulsation may be generated in the test fluid. Even at this time, the pressure pulsation is reduced while being transmitted into the volume enlargement chamber 51. Accordingly, as shown in FIG. 2, a fluid pressure in the injector 10 is substantially constant while the injection hole 13 is opened other than a rise time of the pulse current, that is, a time immediately after detaching the needle 12 from the valve seat 11*a*. Therefore, for every injection, the test-fluid injection amount never fluctuates, thereby accurately measuring the test-fluid injection amount using a low number of injections. Also, the adjusting pipe 15 can be fed while the fluid injection amount is measured, so that the measured flow amount can reach the target amount in a short time.

The pressure pulsation generated in the test fluid within the injector 10 is reduced in the volume enlargement chamber 51, and it is never transmitted to the pump 20. Here, the passage member of the injection-amount measuring unit changes in length and curvature for every injection-amount measuring unit. Even in this case, when the control current supplied to the injector 10 has the same pulse width and the same amplitude, the injection amount of the injector 10 is not changed for every injection-amount measuring unit. Even when the pressure of the fluid supplied to the injector 10 is changed, the injection amount of the injector 10 can be prevented from being changed for every injection-amount measuring unit. Accordingly, a degree of freedom of a set condition of the injection-amount measuring unit can be increased.

An end of the opening-closing valve member 43 is located in the volume enlargement chamber 51 at a side of the fluid outflow passage 53. Therefore, the pressure pulsation transmitted from the injector 10 into the volume enlargement chamber 51 can be readily reduced. For the same reason, eddy streams can be prevented from being generated in the test fluid flowing from the volume enlargement chamber 51 into the fluid outflow passage 53, thereby accurately measuring the injection amount of the injector 10.

In the injection-amount measuring unit of the present example, the feed distance of the adjusting pipe 15 of the injector 10 is adjusted while the injection amount of the injector 10 is measured. However, only the injection amount measurement may be performed in the injection-amount measuring unit. The injection-amount measuring unit measures the injection amount of the injector 10 for a gasoline engine, but it may measure the injection amount of an injector, having no adjusting pipe, for a diesel engine.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An injection-amount measuring unit and fuel injector, the fuel injector including a valve member for performing intermittent fuel-injection by being seated on and then lifted from a valve seat using reciprocating movement and an electric driving member for driving the valve member, the injection-amount measuring unit comprising:

a fluid supply device for supplying a fluid to the fuel injector;

a fluid supply passage through which a fluid is supplied from the fluid supply device to the fuel injector;

a volume enlargement chamber in the fluid supply passage, wherein a passage area of the volume enlargement chamber is larger than that of a fluid inflow passage and that of a fluid outflow passage, wherein a fluid flows from a side of the fluid supply device through the fluid inflow passage, to a side of the fuel injector and into the volume enlargement chamber and through the fluid outflow passage;

a flow meter for measuring an amount of the fluid supplied from the fluid supply device and injected from the fuel injector;

a force applying member for applying a force to the valve member to provide reciprocating motion of the valve member;

an adjusting pipe that contacts the force applying member and adjusts the force applied by the force applying member, wherein the electric driving member generates an attracting force for attracting force for attracting the valve member against the applied force, an electric feed device for adjusting a feed distance of the adjusting pipe; and a control unit for controlling a control current supplied to the electric driving member and the electric feed device.

2. The injection-amount measuring unit according to claim 1, wherein the volume enlargement chamber is provided around a fuel inlet of the fuel injector.

3. The injection-amount measuring unit according to claim 1, wherein the fluid inflow passage and the fluid outflow passage are substantially perpendicular to each other.

4. The injection-amount measuring unit according to claim 2, wherein the fluid inflow passage and the fluid outflow passage are perpendicular to each other.

5. The injection-amount measuring unit according to claim 3, wherein the fluid inflow passage and the fluid outflow passage are perpendicular to each other.

6. The injection-amount measuring unit according to claim 4, wherein the fluid inflow passage and the fluid outflow passage are perpendicular to each other.

7. An injection-amount measuring unit and fuel injector, the fuel injector including a valve member for performing intermittent fuel-injection by being seated on and then lifted from a valve seat using reciprocating movement and an electric driving member for driving the valve member, the injection-amount measuring unit comprising:

a fluid supply device for supplying fuel to a fluid supply passage, wherein the fluid supply passage has a flow meter for measuring an amount of a fluid supplied from the fluid supply device and injected from a fuel injector;

a volume member defining a volume enlargement chamber within the fluid supply passage, wherein a passage area of the volume enlargement chamber is larger than that of a fluid inflow passage and that of a fluid outflow passage;

an opening-closing valve member, a part of which is contained within the volume enlargement chamber, the opening-closing valve member guiding a feed screw, the feed screw contacting an adjustment pipe which controls a needle opening amount for opening and closing an injection hole defined within a housing;

a force applying member for applying a force to the valve member to provide reciprocating motion of the valve member;

an adjusting pipe that contacts the force applying member and adjusts the force applied by the force applying member, wherein the electric driving member generates an attracting force for attracting the valve member against the applied force;

an electric feed device for adjusting a feed distance of the adjusting pipe; and a control unit for controlling a control current supplied to the electric driving member and the electric feed device.

8. The injection-amount measuring unit of claim 7 wherein, the fluid outflow passage and the fluid inflow passage have flow directions that are perpendicular to each other.

9. The injection-amount measuring unit of claim 7 wherein, the adjusting pipe adjusts a force applied to the needle to ultimately control a reciprocating motion of the needle.

10. The injection-amount measuring unit of claim 7 wherein, the fluid inflow passage flows into the volume enlargement chamber and is perpendicular to the feed screw.

11. The injection-amount measuring unit of claim 7, wherein a driving circuit controls an amount of duel to be fed into the fuel injector so that each fuel injection amount is accurately measured.

12. An injection-amount measuring unit comprising:

a fluid supply device for supplying fuel to a fluid supply passage, wherein the fluid supply passage has a flow meter for measuring an amount of a fluid supplied from the fluid supply device and injected from a fuel injector;

a volume member defining a volume enlargement chamber within the fluid supply passage, wherein a passage area of the volume enlargement chamber is larger than that of a fluid inflow passage and that of a fluid outflow passage; and an opening-closing valve member, a part of which is contained within the volume enlargement chamber, the opening-closing valve member guiding a feed screw, the feed screw contacting an adjustment pipe which controls a needle opening amount for opening and closing an injection hole defined within a housing, wherein a driving circuit controls an amount of fuel to be fed into a dummy injector before being injected into the fuel injector so that each fuel injection amount is accurately measured.

* * * * *